United States Patent [19]

DiRe et al.

[11] Patent Number: 4,836,546

[45] Date of Patent: Jun. 6, 1989

[54] GAME WITH MULTIPLE WINNING WAYS

[76] Inventors: Felix M. DiRe, 5155 Clearview Dr., Williamsville, N.Y. 14221; Joseph Carlisi, 3717 Evansdale Dr., Doraville, Ga. 30340

[21] Appl. No.: 216,815

[22] Filed: Jul. 8, 1988

Related U.S. Application Data

[63] Continuation-in-part of Ser. No. 85,751, Aug. 17, 1987, Pat. No. 4,756,531.

[51] Int. Cl.[4] ..... A63B 71/04

[52] U.S. Cl. ..... 273/138 A; 273/143 R; 364/412

[58] Field of Search ..... 273/138 A, 143 R, 1 E, 273/85 G, DIG. 28; 364/410–412

[56] References Cited

U.S. PATENT DOCUMENTS 4,756,531 7/1988 DiRe et al. ..... 273/138 A

FOREIGN PATENT DOCUMENTS 2062923 5/1981 United Kingdom ..... 273/143 R
2086632 5/1982 United Kingdom ..... 273/143 R
2137392 10/1984 United Kingdom ..... 273/143 R

*Primary Examiner*—Leo P. Picard
*Assistant Examiner*—Jessica J. Harrison
*Attorney, Agent, or Firm*—James J. Ralabate

[57] ABSTRACT

An apparatus and game process having two steps, Step I and Step II, is disclosed having three ways of winning. In step I, the player preselects up to "Y" numbers, "Y" is equal to the number of indicators on the apparatus. In Step, I, the first way of winning (or becoming eligible to win) is by selecting any winning number which will be displayed on any one indicator. The second way of winning is by preselecting a number that occurs more than once in at least two indicators. The third way of winning is by preselecting sequence of occurrence of any number in any indicator. If a person has become eligible to win because of Step I, he or she can then in Step II hold winning numbers and re-spin the others at least once. In Step I or as another second step, he or she can play high-low in a plurality of ways, one of which is adding up the values on the winning indicators. Another Step II would be to answer trivia type questions in order to win the awards of Step I.

6 Claims, 2 Drawing Sheets

| | 17 MATCHED | | | | | 18 BONUS POINTS ON MULTIPLE OCCURANCE | | | | 19 BONUS POINTS ON SEQUENTIAL ORDER | | | | | |
|---|---|---|---|---|---|---|---|---|---|---|---|---|---|---|---|
| REELS | A | B | C | D | E | 2C | 3C | 4C | 5C | M2 | M3 | M4 | M5 | PAYBACK | HIT FREQUENCY |
| 20 FIRST COIN | 1 | 2 | 3 | 4 | 5 | 5 | 7 | 50 | 5000 | | | | | 86.5% | 22.6% |
| SECOND COIN | 1 | 2 | 3 | 4 | 5 | 5 | 10 | 75 | 10000 | 5 | | | | 88% | 40.9% |
| THIRD COIN | 1 | 2 | 3 | 4 | 5 | 5 | 15 | 100 | 15000 | 5 | 30 | | | 89.4% | 55.6% |
| FOURTH COIN | 1 | 2 | 3 | 4 | 5 | 5 | 20 | 125 | 20000 | 10 | 40 | 500 | | 93.06% | 67.2% |
| FIFTH COIN | 1 | 2 | 3 | 4 | 5 | 5 | 25 | 150 | 25000 | 10 | 50 | 1000 | 250000 | 97.3% | 76.2% |

7

Fig. 2

GAME WITH MULTIPLE WINNING WAYS

This application is a continuation-in-part application of parent application Ser. No. 07/085,751 filed Aug. 17, 1987, now U.S. Pat. No. 4,756,531.

This invention relates to a novel game apparatus and process and, more particularly, to a game of chance wherein a player can simultaneously win in two or more ways.

BACKGROUND OF THE INVENTION

It is known in games of chance to use wheels, reels, balls, dice, darts and the like to determine winning numbers or symbols. Some of the more popular games known today are roulette, Keno, Bingo, wheels of chance, lotteries, slot machines and other gaming devices. All of these games allow the player to win on a single number or numbers in one wheel or drawing or spin. In roulette, for example, the player selects a number having certain odds or payoff, the roulette wheel is spun and he has one chance to win. Each roulette game provides a small opportunity of winning to each player and generally there are few winners, if any, on each spin. In Keno, the same is generally true; the player selects numbers and then compares with the winning numbers posted. In games involving the spinning of wheels with a plurality of numbers, the players watch the spin of one wheel to determine if their selected number is where the wheel stops.

In most of these games the element of excitement is at a minimum since there is generally only one way to win and the potential of winning is small.

SUMMARY OF THE INVENTION

It is therefore an object of this invention to provide a novel game that is devoid of the above-noted disadvantages.

A further object of this invention is to provide a novel game that allows the player several opportunities to win, hereinafter also referred to as "winning events".

Another object of this invention is to provide a game that can be used in casinos, at home, on T.V. programs and in other suitable locations whereby the player can play from two to ten games at one time and can repeat the process, if desired.

Another object of this invention is to provide a game wherein a player can win in several ways and a game where wild indicators can be used as desired.

Still a further object of this invention is to provide a game wherein the player can be in some instances eligible or qualify to win in three separate ways in the same game, then can re-play or can answer questions to actually win on those qualified.

A yet further object of this invention is to provide a game that is simple to comprehend yet exciting to play.

These and other objects of this invention will become apparent upon a reading of this disclosure and are provided generally by a game involving as Step I, preselection of numbers. The game of this invention will be described throughout as being played by a single player; however, there can be multiple players or even teams. A novel feature of this invention is that with a single coin, a player's single selection can have available two or more chances of simultaneously winning at one time. That is, two or more substantially identical indicators will randomly offer many possible simultaneous winning events and combinations of winning events thereby enhancing the excitement of the game. To add further interest, the player may play more than one game at a time. That is, for each additional coin inserted, he may make an additional selection, each selection being both an independent game and part of a game using each independent game as an equal part of its whole; the addition of the now increased possible substantially simultaneous winning events offering more excitement to the play of the game. The player may also play a high-low game at this stage. The above constitutes generally Step I of this invention.

As Step II, the player can do any of the following:

(a) He (or she) can compare the winning numbers with those preselected, hold the numbers he (she) desires by freezing the reel and re-spin or re-play the other reels at least once.

(b) He (she) can select either high or low when preselecting in Step I and then determine by adding the sum of the numbers on the winning indicators (1) in Step I only or (2) in Step II only or (3) in both Steps I and II, to determine if high or low won.

(c) He (she) can perform Step I but rather than winning in Step I, he (she) only becomes elegible to win if he (she) subsequently answers questions. This step could conveniently be used on a game show on T.V.

The Steps I and II can be used also on instant preprinted tickets or can be in dart games, shuffleboard games, or several types of games involving balls with numbers or colors. The game will be described initially by its basic or fundamental concepts. However, it can be used in T.V. shows, automatic slot machine or home games. Also, the game will be described throughout with reference to the use of numbers only; however, in place of or together with numbers, one can use letters, symbols, colors, characters or the like. When the term "number" or "numbers" is used throughout, it is intended in the preferred embodiment to mean any different type indicia such as numbers, colors, letters, symbols, characters or wild numbers, colors or symbols that can be whatever the player desires to enhance his chance of winning. The terms "location(s)" or "position(s)" mean dart positions, shuffleboard positions, balls with numbers, numbers of the wheel or reel(s) A, B, C, D, or E in the drawings FIG. 1 indicated by 4A, 4B, 4C, 4D and 4E. Thus, by "location" is meant that selection position or location where the preselected number is; for example, if a player picks numbers 2, 4, 6, 8 and 10, number 4 is in the second (B) location and number 6 is in the third (C) location, etc. The term "win" or "winning number" means a preselected number that appears in a stopped point of an indicator. The term "win" also is intended to include eligible to win. "Indicator(s)" (selectors) in this disclosure are also referred to as dartboard locations, shuffleboard locations or reels, wheels and balls and are used throughout to mean the same device, which can be any indicator with two or more possible stopping locations. Also, one or more "wild" stopping positions may be added to one or more indicators. With "wild" stopping positions, the chances of winning in all ways are increased significantly. "Preselected" in Step I means automatic preselection or manual preselection of up to "Y" different numbers. "Preselected" also includes rather than manual preselection, other qualifying events such as a choice of questions numbered, for example, 1–20. If the player wants question no. 6, and answers it correctly, no. 6 becomes the preselected number in the first location. If the player subsequently chooses to answer question no. 8, and does not correctly answer that question, then the second location is blank, etc. This question-answer process is included throughout this disclosure in the terms "Preselected" or "Preselect". The designation "Y" indicates any whole number greater than one. Thus "Y" indicates the number of indicators, which is always equal to the maximum amount of allotted preselections. "Y" therefore represents both the maximum number of preselections and the number of indicators. Also, while one to five preselected numbers and 1–20 stopping positions for each of five indicators (wheels) will be used to illustrate the preferred embodiment of the invention, any amount of preselected numbers, stopping positions and indicators may be used (as in an embodiment which utilizes one to seven preselected numbers, 254 stopping positions and seven indicators (balls). The designation of "X" in the claims and disclosure indicates any whole number greater than one. Thus, "X" indicates the number of available numbers to be preselected from which is always equal to the number of stopping positions on the reel or wheels. "X" therefore represents both the amount of numbers available for preselection and the number of stopping positions for the indicators.

In its simplest form the game will be described with reference to one player and to specific numbers; however, it whould be understood that "Y" can be greater than 5 and "X" greater than 20. The player selects from 1–5 numbers ("Y") from 20 available numbers ("X"). He then spins 5 indicators ("Y") which for illustrative purposes are "wheels" having 20 stopping locations ("X"). Any of the preselected 1–5 numbers can come up on any of the five wheels spun. The following examples will further define the game of this invention. These examples are intended to be for illustration and not limitation of the invention. "Indicated Numbers" in this disclosure means the number shown or printed at the stop point of the indicator including "wild" stop points or "wild" cards that can be used any way the player desires.

In parent application Ser. No. 07/085,751 examples I–XI describe in detail ways a player can win in Step I of the game disclosed therein. Each of these examples I–XI are in the invention disclosed herein as Step I. In Step I or II of the game of this invention, wild indicators can be used on one or more reel giving the player additional chances of winning in any of the three ways of winning in Step I. Also, rather than actually winning as in Ser. No. 07/085,751, in the present application the player may in some instances become only eligible to win and in some cases, must successfully complete Step II in order to actually win.

For instance:

(a) In Example X of Ser. No. 07/085,751, a player selects five numbers: 3, 6, 9, 12 and 15. He pulls the machine lever to activate the reels with the following results:

| Reels | A | B | C | D | E |
|---|---|---|---|---|---|
| Indicated No. | 3 | 3 | 9 | 12 | 11 |

Since he won on all reels except reel E, he could freeze or hold reels A–D and respin reel E and attempt to win again on that reel, or (b) he could play a high-low game in either or both Steps I and II by adding up the numbers on reels A–E to determine if they fall above or below a fixed number, or (c) in Step II he must answer a trivia or other question in order to win on the results of his first spin.

To further illustrate embodiments A, B and C of Step II of the present invention, the following examples are presented.

EXAMPLE I

The player selects in Step I from numbers 1–20 each on five reels or wheels, the numbers 4, 7, 10, 13 and 15. He spins the wheels (or activates reels) and the following numbers are included when the wheels (reels) stop on:

| Reel | A | B | C | D | E |
|---|---|---|---|---|---|
| | 4 | 7 | 11 | 11 | 15 |

Then, in Step II at least one of the following embodiments:

In Embodiment A

He lost on reels C and D and won (or eligible to win) on reels A, B and E. He can freeze or hold on reels A, B and E and respin reels C and D to have a second chance to win on these reels. If, on respinning reels C and D, one or more of the numbers preselected (i.e. 4, 7, 10, 13 and 15) appear, he would then also win on reels C and D.

In Embodiment B

He can play a high-low game; for example, if high is above 50 and low is from 1–49, by adding up his preselections 4, 7, 10, 13 and 15 the total is 49. Thus, he would be playing low. After the spin, adding up the winning numbers on reels A, B, C, D and E, i.e. 4, 7, 11, 11 and 15 or total of 48 he would win because the total was below 50 as he predicted. The player may play high-low at any stage of the game, i.e. (A) can play high-low in Step I only; (B) can play high-low in Step II only; or (C) can play high-low in both Steps I and II separately or together.

In Embodiment C

Step I makes the player eligible to win only if he answers a question or questions in Step II. This embodiment can be used in home game, T.V. or radio shows.

EXAMPLE II

The player preselects in Step I numbers 3, 8, 19, 17 and 18. He spins the reels and the following numbers appear after the spin:

| Reel | A | B | C | D | E |
|---|---|---|---|---|---|
| Indicated No. | 3 | 4 | 6 | 1 | 18 |

Then, in Step II he does at least one of the following embodiments:

In Embodiment A

The player lost on reels B, C and D and won (or eligible to win) on reels A and E. He or she can freeze or hold reels A and E and respin reels B, C and D to have a second chance to win. If one or more of the preselected numbers appear on reels B, C and D he would win also on those reels. For instance, if the following appeared on the respin of B, C and D:

| Reel | B | C | D |
|---|---|---|---|
| Indicated No. | 3 | 17 | 12 |

The player would also win on reels B and C since preselected numbers of Step I, 3 and 17 appeared on reels B and C. He would lose on reel D since none of the preselected numbers appeared on reel D. Thus, in the complete game Step I and embodiment A of Step II, the player would win on reels A, B, C and E. The awards would be as outlined in Example 3 below.

In Embodiment B

The player can play a high-low game taking an arbitrary number 50 or above as "high" and 1–49 as "low". The player predicts what the total will be of reels A–D when stopped or after the spin. This could be in just Step I or in respin of Step II, or both. In this example the player selects "high" since adding his preselected numbers 3, 8, 19, 17 and 18 totals 65 or above 50. Since the reel spin produced numbers 3, 4, 6, 1 and 18 or a total of 32 or low, the player would lose on high-low game. Any form of high-low may be played including the respin or combinations of respin and original spin.

In Embodiment C

The spin in Step I makes player eligible to win if he later answers a question (or performs successfully an activity) of Step II. Thus, in this example, the player won on reels A and E and thus becomes eligible to collect on this win of A and E if and only if he performs Step II successfully such as answering a question on any subject.

EXAMPLE III

To further describe the game of this invention, award points are assigned each wheel (or reel) on either spin or respin, or both.

(a)
Wheel A—1 point
Wheel B—2 points
Wheel C—3 points
Wheel D—4 points
Wheel E—5 points (b) Bonus points are also assigned if one preselected number comes up on more than one wheel (per coin inserted).

2 Wheels—5 points
3 Wheels—7–25 points
4 Wheels—50–150 points
5 Wheels—5000–25,000 points (c) If the numbers are picked sequentially or in position on each wheel, additional bonus points are awarded as follows (per coins inserted):

2 Wheels—5 points
3 Wheels—30–50 points
4 Wheels—500–1000 points
5 Wheels—250,000 points Thus, the game of this invention in Step I and later in Step II provides award points for:

A. Preselecting or picking a winning number of hits, plus

B. A bonus if the winning preselected number comes up on more than one wheel, plus C. A bonus if any two to five numbers are picked in the position which corresponds to the winning locations or positions; i.e., 1st number on wheel A
2nd number on wheel B
3rd number on wheel C
4th number on wheel D
5th number on wheel E.

A bonus is also awarded for preselecting the correct sums of the numbers in any or all of the indicators.

EXAMPLE IV

In the same machine as in above examples and with the awards or values of Example III, the player selects five numbers: 3, 6, 9, 12 and 15 and, therefore, deposits 5 coins. He pulls the lever to activate the reels with the following results:

| Reel | A | B | C | D | E |
|---|---|---|---|---|---|
| Indicated Nos. | 3 | 3 | 9 | 12 | 11 |

| | |
|---|---|
| (a) Winning numbers: | |
| 3 on reel A = | 1 point |
| 3 on reel B = | 2 points |
| 9 on reel C = | 3 points |
| 12 on reel D = | 4 points |
| (b) Bonus awards: | |
| 3 in reels A & B = | 5 points |
| (c) Bonus awards sequential: | |
| 3 on reel A | |
| 9 on reel C | |
| 12 on reel C = | 30 points |
| Total Award = | 45 points |

The player then goes on to Step II and at least one of the Step II embodiments A, B or C.

A further modification of Steps I and II is a skill game played as follows:

The equipment would be a dart board or a shuffle board called a "Play board" with 5 (2–10) locations, in which a value is given to each location; 5 (2–10) "devices" which would be used by the player to "land" in each of the locations. The Value of each location should be in contrasting proportion to the relative size of the area of the location. The smaller the area, the larger the value. The "locations" on the board, and the "devices" used by the player should be color coded, or numbered to allow for the identification of winning ways.

The preferred play boards are either a regulation size dart board configured with a bullseye, and as many rings as desired (say 5); or a shuffle board type of layout which is configured with aligned areas which diminish in size. The corresponding "devices" would be either darts or pucks.

The player throws (slides) each of the "devices" into, or onto, the "play board". His score is determined by where the devices land on the board in any or all of the established ways.

Hits: Any "device" in any "location".

Matches: More than one "device" in the same "location".

Spots: A numbered or color coded device in the correspondingly numbered or color coded location on the board.

Sum: The sum of the points attached to the value of each location.

BRIEF DESCRIPTION OF THE DRAWINGS

FIG. 2 is a chart showing the awards made by winning combinations in the preferred embodiment of the present invention.

DESCRIPTION OF THE DRAWINGS AND OF THE PREFERRED EMBODIMENTS

Figure 1:
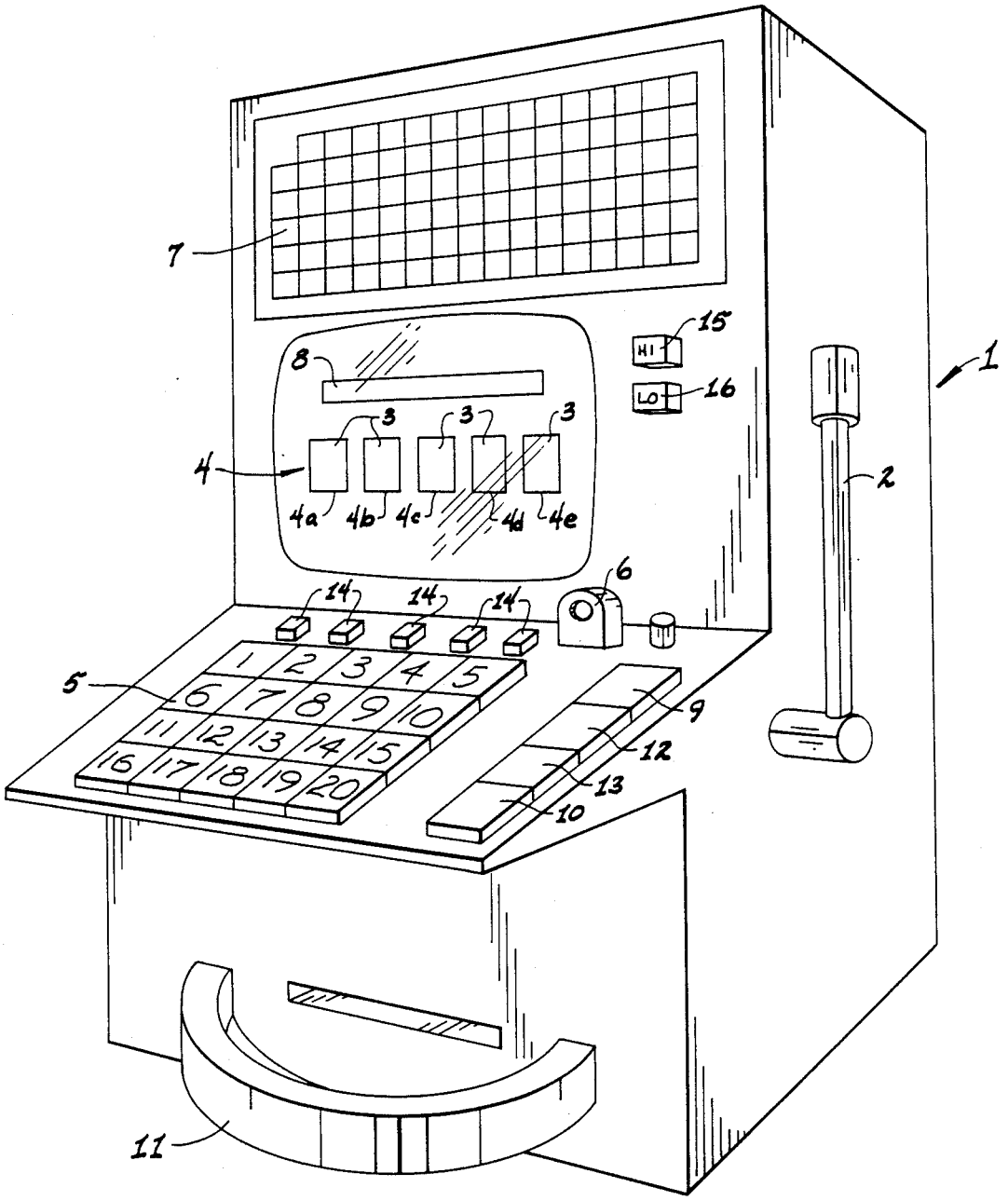
FIG. 1 is a perspective view showing a slot machine constructed in accordance with the preferred embodiment of the present invention.

In FIG. 1 the preferred embodiment is shown wherein a slot machine 1 is illustrated having an arm or activating means 2 for initiating or activating the spinning of five reels which have stopping points 3 that will be indicated at winning indicator or display means 4. A selector keyboard 5 having from 1–20 numbered buttons or squares is provided for preselection by the player of up to five numbers. Any amount of numbers may be used on keyboard 5 but must be the same as the amount of numbers on each reel. For clarity, twenty numbers are illustrated in accordance with the above description in the examples. Also, while one to five numbers are suggested for preselection by the player or players, any suitable amount of numbers can be used, the upper limit being equal to the number of indicators. After the appropriate coins are inserted in coin insert 6 keyboard 5 is pressed in Step I to select from one to five numbers, depending on the coins inserted. For example, if four numbers will be selected in Step I of this invention, four coins must be inserted in coin insert 6 arm 2 is pulled to activate the reels which will randomly stop at position numbers indicated at indicator displays positions 4A, 4B, 4C, 4D and 4E. Located in a prominent place on machine 1 is an award plate 7 which outlines the points and bonus points or coins earned by winning results or events after Step II is completed. This award plate 7 will be discussed at length later in relation to FIG. 2. Again, the award plate 7 and the foregoing discussion have been presented with reference to from 1–20 possible selections of numbers and from 1–5 preselected choices (that will be shown when made at preselect display 8). However, any amount of numbers greater than 1 may be used in the preselect step in order to become eligible for the sequential bonus awards of the game defined herein. That is because more than one number must be bet for there to be a sequence or order of numbers. However, a bonus can be achieved if only one number is played on the occurrence bonus aspect. After the appropriate amount of coins have been inserted or deposited in coin insert 6 and the numbers to be bet are selected and registered at display 8 arm 2 is moved to activate reels that will stop randomly and displayed at their stop point 3 in display reel windows positions 4A, 4B, 4C, 4D and 4E. Preselect display 8 then can be compared with display windows 4 to determine winning numbers or numbers eligible to win conditioned in some instances upon success in Step II of this invention. There is also a credit display window 9 and payout display window 10 that indicates the points or coins won, if any. To claim the coins won, payout button 10 may be pressed to release coins won that will be delivered through coin tray 11. Other features such as start button 12 and clear button 13 may be incorporated in the present invention, if desired. Start button 12 is pressed or used to begin each game and clear button 13 may be used when the player has changed his mind and would like to change his selection of one or more preselected numbers before pressing the start button 12 or moving the arm 2 to activate the reels.

One of the advantages of the present invention is that there are many ways to win which adds to the excitement of the game in the same game. A player can win by selecting 1, 2, 3, 4 or 5 winning numbers, he can win by predicting the positions or sequence on winning indicators 3 or he can win by any one of these numbers occuring more than once (up to 5) on the reels activated; if the first number preselected comes up more than once, a bonus is awarded, the same with the second, third, fourth and fifth preselected number. Thus, he can win by picking just one number and having five chances of that one number coming up on any of five wheels A, B, C, D or E. Therefore, the player may play several different ways with one game, winning simultaneously on any of five wheels, winning on predicting or selecting positions or sequence if he picks more than one number, winning on occurrence of the same number or any combination of these. There are display means in the present game for substantially simultaneously displaying in Steps I and II all of these ways of winning.

After Step I has been completed, that is, the numbers have been preselected, the positions or location on winning indicators 3 predicted, and the winning numbers on each reel 4A, 4B, 4C, 4D and 4E, determined, Step II is initiated. Hold means 14 can be located below display reel windows 4A, 4B, 4C, 4D and 4E to hold or freeze the particular reel desired. For example, if winners are on reels 4B and 4D, these reels can be held by pressing hold buttons 14 and reels 4A, 4C and 4E can be freed for re-spin. The re-spin is accomplished in the same manner as above described for the initial spin with or without the deposit of additional coins depending on the desired system. This re-spin has earlier been described as Step II embodiment A.

Concurrent of subsequent to Step I, a high-low game can be played where the player pushes "high" button 15 or "low" button 16. Any number can be used as the cut-off between high and low, for example, 1–49 could be considered low and 50 and above considered high. So, in Step I or in Step II embodiment B, the player can play high-low in addition to the described game of Step I, i.e. a simultaneous win when any number preselected appears on any one of winning indicators 4A, 4B, 4C, 4D or 4E; a win when any number preselected at a given location corresponds to the winning location as shown in 4A, 4B, 4C, 4D and 4E; and a win when any number preselected occurs or appears in at least two of said winning indicators 4A, 4B, 4C, 4D or 4E.

After Step I is completed, rather than an actual win determined in Step I, all Step I accomplishes in Step II(c) is to establish the prize available if Step II is completed successfully by the player. Step I in effect determines the prize or prizes eligible to be won by Step II. Step II preferably is a question or questions of a general nature that, if answered correctly, awards the prizes identified in Step I.

Award plate 7 is expanded in FIG. 2 to show the various ways or categories of winning with the awards or eligible awards of Step I and actual awards of Step II. In FIG. 2, A, B, C, D and E represent five different reels which spin independently of each other; 1C represents occurrence of one preselected number, 2C the occurrence of that number twice, 3C occurrence of that number 3 times, 4C occurrence 4 times and 5C occurrence 5 times. $M_2$ represents two numbers in order of preselection, $M_3$ represents three numbers in order of preselection, $M_4$ four numbers in order of preselection and $M_5$ five numbers in order of preselection.

Award plate 7 illustrates in the first set of columns 17 the awards of payoff for selection of a winning number, column sets 18 to show the awards or payoffs for multiple (more than 1) occurrence of that number selected, and column set 19 shows the awards or payoff for selections made in order of appearance on the reels spun. In set 19 more than one number must be bet or selected for an award of sequence of order. In the lefthand column 20 are listed the number of coins played and reading to the right the various awards of payoffs in each of columns 17, 18 and 19. For example, if 3 coins are played or inserted into coin insert 6, (3 numbers selected), and two numbers of selections are winners in reels A and B (come up on reels A and B), then 3 coins are awarded. If one number selected comes up twice, once in wheel A and once in wheel B, then per column 18, 5 additional coins are awarded, i.e., 5 for third coin. If 2 selections match sequence of appearance on windows or displays 3 (of FIG. 1), then shown in columns 19 of FIG. 2, 5 additional coins are awarded, i.e. 5 for third coin deposited. Award plate 7 as shown in FIGS. 1 and 2 will be more specifically described in following further examples when read with reference to FIG. 2.

DESCRIPTION OF CHART FIG. 7

EXAMPLE V 1 coin played=1 selection (Selection I). Selection I may win in any or all reels (A–E).

| | |
|---|---|
| (A) | If Selection I appears in Reel A the payout is 1 coin. |
| | If Selection I appears in Reel B the payout is 2 coins. |
| | If Selection I appears in Reel C the payout is 3 coins. |
| | If Selection I appears in Reel D the payout is 4 coins. |
| | If Selection I appears in Reel E the payout is 5 coins. |

(B) If Selection I appears in any two reels the player is awarded the total of each reel position plus a bonus of 5 coins.

Selection I in any 3 reels pays the total of each reel position plus 7 bonus coins.

Selection I in 4 reels pays 50 bonus coins.

Selection I in 5 reels pays 5000 bonus coins.

(For above awards, see FIG. 2 chart.)

EXAMPLE VI 2 coins played=2 selections (I and II).

As in Example V of Ser. No. 07/085,751, either selection I or II may win in either or all reels (A–E) plus an additional bonus of Selection I and Selection II are matched with reel A and reel B, respectively.

By playing two coins, the player (1) plays two games at once; (2) receives increased awards for bonus level 1; and (3) has an additional way of winning, bonus level 2 Selection I and II matched.

EXAMPLE VII 3 coins played=3 selections (I, II and III).

As above, either selection I, II or III may win in either or all reels; plus a bonus if either selection appears in 2 or more reels; plus a bonus if either two or three of the selections are matched with reel positions. By playing three coins, the player: (1) plays 3 games at once; (2) receives increased awards for multiple occurrence; and (3) has 4 categories at winning in sequential order.

| | |
|---|---|
| Selections | I & II matched |
| | I & III matched |
| | II & III matched |
| | I, II & III matched |

EXAMPLE VIII 4 coins played=4 selections (I, II, III and IV).

As above, either Selection I–IV may win in either or all reels plus an increased bonus award if either selection appears in 2 or more reels; plus a bonus if either two, three or four of the selections are matched with reel positions.

By playing 4 coins, the player (1) plays (4) games at once; (2) receives increased awards for multiple occurrence bonus; and (3) has eleven categories or ways at winning in sequential order bonus.

| | |
|---|---|
| Selections I & II | matched |
| Selections I & III | " |
| Selections I & IV | " |
| Selections II & III | " |
| Selections II & IV | " |
| Selections III & IV | " |
| Selections I, II & III | " |
| Selections I, II & IV | " |
| Selections I, III & IV | " |
| Selections II, III & IV | " |
| Selections I, II, III & IV | " |

EXAMPLE IX 5 coins played=5 selections (I, II, III, IV and V).

As above, either selection I–V may simultaneously win in either or all reels plus a bonus if any selection appears in 2 or more reels; plus a bonus if any two, three, four or five selections are matched with reel positions.

By playing five coins, the player (1) plays 5 games at once; (2) receives increased awards for multiple occurrence bonus; and (3) has 26 categories or ways of winning in sequential order.

The chart below explains this.

| | |
|---|---|
| Selections I & II | matched |
| Selections I & III | " |
| Selections I & IV | " |
| Selections I & V | " |
| Selections II & III | " |
| Selections II & IV | " |
| Selections II & V | " |
| Selections III & IV | " |
| Selections III & V | " |
| Selections IV & V | " |
| Selections I, II & III | " |
| Selections I, II & IV | " |
| Selections I, III & V | " |
| Selections I, IV & V | " |
| Selections II, III & IV | " |
| Selections II, III & V | " |
| Selections II, IV & V | " |
| Selections III, IV & V | " |
| Selections I, II, III & IV | " |
| Selections I, II, III & V | " |
| Selections I, II, IV & V | " |
| Selections I, III, IV & V | " |
| Selections II, III, IV & V | " |
| Selections I, II, III, IV & V | " |

A player may also win on high-low sum.

In all above, any combination of winning cases is possible.

Example: Simple wins on either A, B, C, D or E reels, plus bonus wins for single selections appearing in more than one reel, ("multiple occurrence bonus") plus bonus wins for matched positions on reels to any matched positions of any number I–V selected ("sequential or position bonus").

| | | | | | |
|---|---|---|---|---|---|
| Player selects | #1 | #6 | #9 | #11 | #10 |
| Reels stop at: | #1 | #1 | #9 | #9 | #10 |
| Player wins: | | | | | |
| (simple): | #1 in reel A | | | | |
| | #1 in reel B | | | | |
| | #9 in reel C | | | | |
| | #9 in reel D | | | | |
| | #10 in reel E | | | | |
| (multiple occurrence bonus) | #1 in 2 reels (A&B) | | | | |
| | #9 in 2 reels (C&D) | | | | |
| (sequential or position order bonus): | Three preselected numbers in matched winning positions | | | | |
| | Selection | #1 | #9 | #10 | |
| | Reel Position: | A | C | E | |

Throughout the specification and claims, "winning numbers" are defined in terms of "stopping positions" on wheels, reels or indicators. These winning numbers also can be determined from pre-printed tickets with rub-off portions whereunder the winning numbers are indicated. Thus, rather than stopping positions on a wheel, the winning numbers can be pre-printed on a card with a rub-off overcoating.

The preferred and optimumly preferred embodiments of the present invention have been described herein and shown in the accompanying drawings to illustrate the underlying principles of the invention, but it is to be understood that numerous modifications and ramifications can be made without departing from the spirit and scope of this invention.

What is claimed is:

1. A novel game apparatus having the following winning means:

(1) means for preselecting up to "Y" possible winning numbers from a given group of numbers, "Y" being an amount of indicators in said apparatus, a number of said group of numbers in a winning number if it appears on one of said indicators;

(2) means for awarding a win when the number selected at a given location corresponds to the winning location; and (3) means for preselecting said numbers in which said number of (1) occurs in at least two of said winning indicators;

said winning indicators comprising at least two independent means having identical numbers indicated thereon and having identical stopping positions provided thereon, a final stopping position on each of said indicators substantially simultaneously providing the winning numbers of at least two winning means of 1–3 above and display means for displaying said final stopping positions, and means for freezing at least one of said indicators, means for respinning at least one of said indicators, means for determining the sum of said numbers on all the indicators, and means for selecting a high or low value for said sum.

2. The game of claim 1 wherein processes 1–3 are preselected and said winning indicators are reels having the same amount of numbers as the amount of numbers available for preselection.

3. The game of claim 1 wherein processes 1–3 are preselected and said winning indicators are wheels having the same amount of numbers as the amount of numbers available for preselection.

4. The game of claim 1 wherein two to ten independent winning indicators are used, each of said indicators having the same numbers indicated thereon, and the same amount of stopping positions, which equals the amount of numbers available for preselection.

5. The game of claim 1 wherein two to ten independent winning indicators are used, each of said indicators having the same numbers indicated thereon and the same amount of stopping positions and wherein said player preselects up to "Y" numbers, wherein "Y" is equal to the number of indicators, said indicators having depicted thereon an amount of numbers and having an amount of stopping positions of at least five.

6. The game of claim 1 having means for selecting a high or low sum total of the numbers before activating said indicators, and having means for subsequently comparing the resulting sum with the high or low selection previously made.

* * * * *